US005842481A

United States Patent [19]

King

[11] Patent Number: 5,842,481

[45] Date of Patent: Dec. 1, 1998

[54] PORTABLE CIGAR TRAY

[76] Inventor: Paul B. King, 1702 Mensha Ct., Diamond Bar, Calif. 91765

[21] Appl. No.: 998,692

[22] Filed: Dec. 29, 1997

Related U.S. Application Data

[60] Provisional application No. 60/035,634 Jan. 16, 1997.

[51] Int. Cl.[6] ..... A24F 13/02; A24F 13/08

[52] U.S. Cl. ..... 131/187; 131/190; 428/900

[58] Field of Search ..... 131/187, 190; 428/900; D27/175, 183, 186

[56] References Cited

U.S. PATENT DOCUMENTS

| | | | |
|---|---|---|---|
| D. 156,593 | 12/1949 | Angerer | D85/8 |
| D. 206,312 | 11/1966 | Roberts | D85/8 |
| D. 311,600 | 10/1990 | Peracca | D27/170 |
| D. 379,551 | 5/1997 | Hubbard | D27/162 |
| D. 392,410 | 3/1998 | Lukach | D27/183 |
| D. 392,770 | 3/1998 | Scallon et al. | D27/183 |
| D. 395,731 | 6/1998 | Olis | D27/183 |
| 4,971,278 | 11/1990 | Woods | 248/206.5 |

OTHER PUBLICATIONS

The Golfsmith Store Catalog, Mar. 1998, p. 32 (Stogie Holder) and 42 (Cigar Snake).

*Primary Examiner*—Stanley S. Silverman
*Assistant Examiner*—Jacqueline A. Ruller

[57] ABSTRACT

A cradle or tray for holding a lit tobacco product having a V-shaped tray made of aluminum using 90 degree angle stock approximately 1/16 inch thick. A support arm made of a series of plastic link connected at one end to the tray and at its opposite end to a releasable clamp. The tray is fastened to the first link or element of the support arm with a flat head machine screw. The last link or element is fastened to the clamp by a similar screw and nut so that the user can grasp the operating levers of the clamp. The clamp grip is large enough to grasp various support structures such as parts of a golf bag or in an appropriate location on a drivable golf cart.

7 Claims, 2 Drawing Sheets

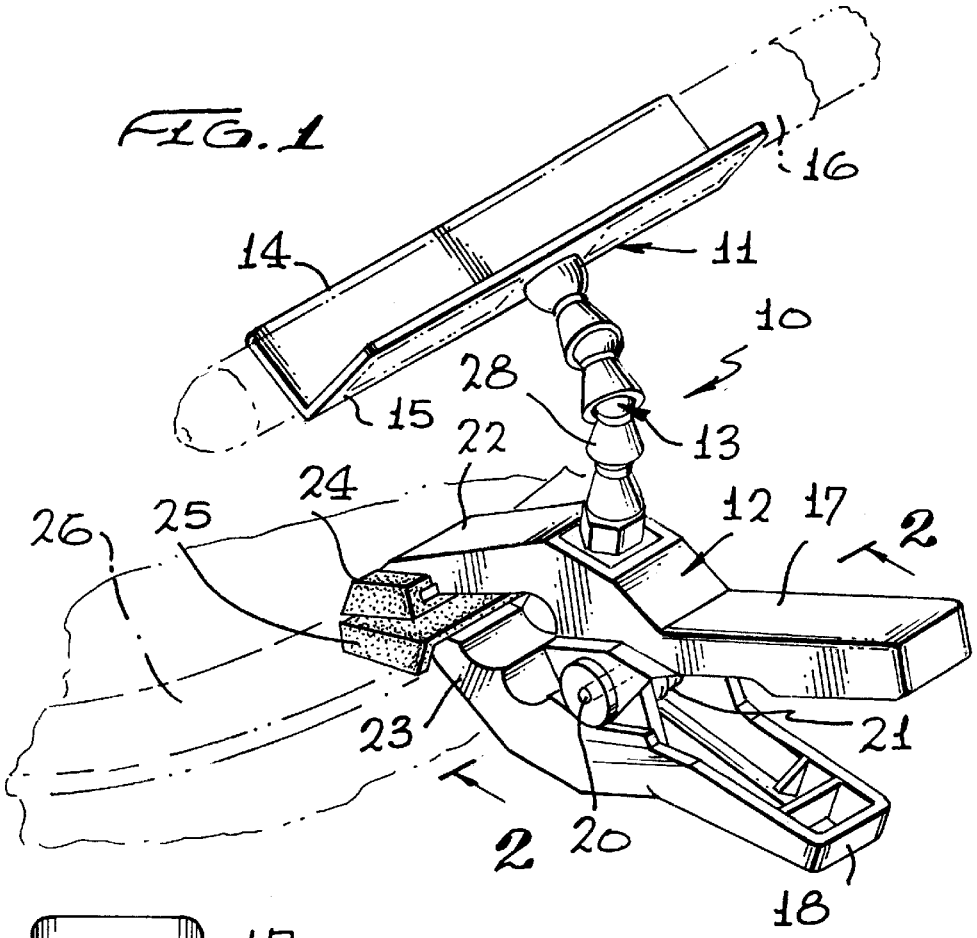
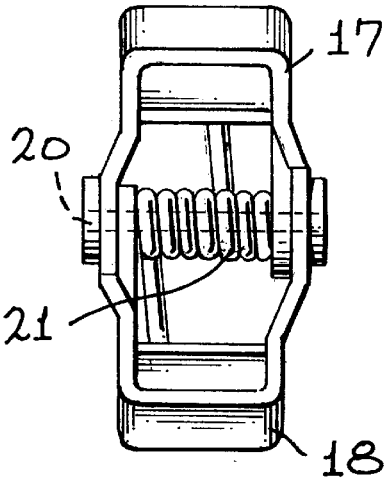
FIG. 2
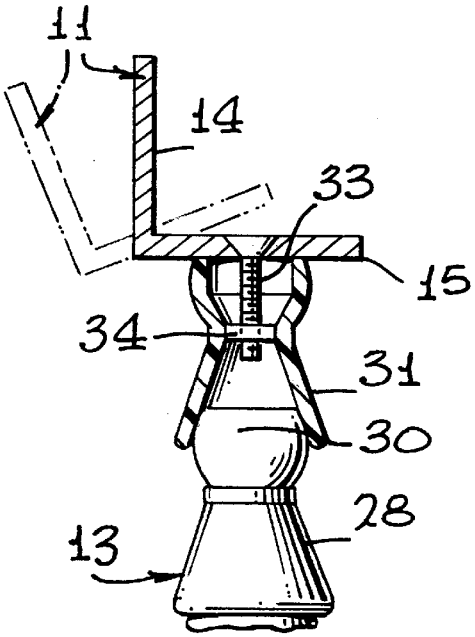
FIG. 3

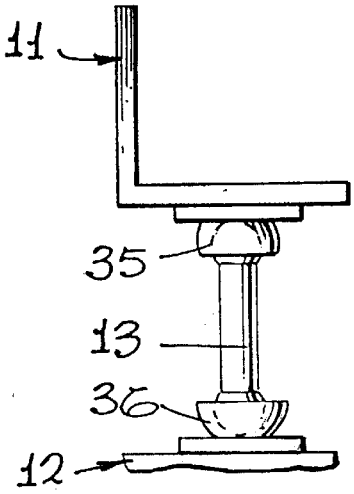
FIG. 4
FIG. 5
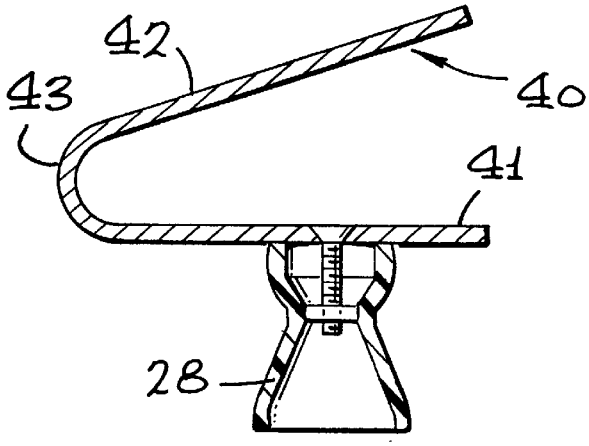
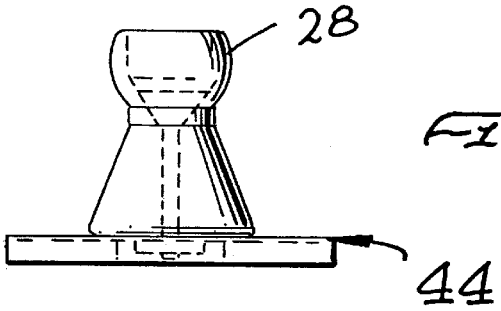
FIG. 6

PORTABLE CIGAR TRAY

Priority Date claimed of Jan. 16, 1997 based on Provisional Application Ser. No.: 60-035,634

BACKGROUND OF THE INVENTION

1. Field of the Invention

This invention relates to cigar smoker's needs to protect their cigars and the wide range of smoking accessories that are available to cigar smokers. Many cigars are very expensive and cigar smokers are very adamant about taking care of them. Some may wait 5 to 10 years to smoke a particular cigar and some even longer. Almost all premium cigar tobacco is aged 3 to 4 years minimum. This should explain, even to a non-cigar lover, why this would be a useful item for a cigar smoker.

2. Brief Description of the Prior Art

This invention discloses a cigar holder which can be used in an adverse environment. The need arose during golf to put down a cigar because it is necessary during play. It is nice to be able to set down the cigar and take a shot or to putt. The normal method is to put it on the ground; however, sometimes the grass sticks to it or, in some cases, it is hard to remember where you put it down if the ground color matches the wrapper color of the cigar. Also, strong pesticides are prevalent on golf courses and frequently the grass is quite wet. Another popular place to put down a cigar is on a golf cart, only to forget it and drive away losing it somewhere on the fairway. The driving range is another ideal place to have a cigar holder.

Attempts have been made to accomplish this goal of "cigar care" on the golf course. One device is a cradle that clips to a golf tee which in turn is pushed into the grass. The cigar can then be set on the cradle. This is done every time the cigar is put down and then the cradle and tee are picked up every time the cigar is picked up. Another device is a golf club length rod that has a cradle on top of it. The user sticks the rod into the ground every time they want to set down a cigar. Both of these devices are a bit arduous to use and really not convenient.

SUMMARY OF THE INVENTION

The inventive tray is unique in that it is positioned in the same place all the time. This sets a new standard in functionality and convenience. The device has a cradle or tray which is attached to an adjustable stem. On the other end, the stem is fastened to a spring-loaded utility clamp. The most common places to clamp the device are on an electric or gas powered golf cart (commonly around the front passenger area) or on a golf bag which is mounted to a pull cart. Also, it could be mounted on a bag which is being carried, especially if the bag has a stand.

Other unique features are the size and configuration of the cradle or tray area. Currently, the cradle is between 4 and 5 inches in length and approximately 2 inches wide making it easy to use. The cradle is in a "V" shape or right angle as opposed to a smooth curved configuration. The curved configuration was considered but the "V" shape more efficiently holds different size cigars securely. The current design of the stem is a sectional, flexible and adjustable support. The sections or links are made of a polymer material and press fitted together with a tight fit which makes a very secure and versatile support. The stem can be easily adjusted and, at the same time, provide the rigidity to hold the tray in position.

Therefore, it is among the primary objects of the present invention to provide a means for removably supporting a cigar or other lighted element on a portable tray which includes a spring-loaded clamp for removably securing the tray to an object such as a golf bag, golf cart or the like.

Another object of the present invention is to provide a novel support for a lighted-cigar which includes a V-shaped tray supported on an articulated arm which is carried on a spring-biased clamp suitable for removably attaching it to a golf bag, golf cart or the like.

A further object resides in providing a tray or holder for a tobacco product whereby an articulated arm is attached at one end to the tray and at the opposite end to a lever of a pivotal spring-biased clamp so that the opposing levers of the clamp can be detachably connected to a support object.

A further object of the invention resides in providing an attachment means for fixedly securing the opposite ends of an articulated arm to a tray at one end and a clamp at the other end which includes a threaded shank of a screw and a threaded matching nut so that the arm may freely articulate or move into selected positions.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view of the novel portable cigar tray incorporating the present invention;

FIG. 2 is a rear elevational view of the portable cigar tray shown in FIG. 1 as taken in the direction of arrows 2—2 thereof;

FIG. 3 is an enlarged sectional view of the attachment of one end of the articulated arm to the cigar supporting tray;

FIG. 4 is a reduced elevational view of the cigar tray supported on a movable or adjustable arm having a rigid shaft connected between a pair of universal joints attached to the tray and the clamp respectively;

FIG. 5 is a sectional view of a tray having releasable tension applied to the tobacco product; and FIG. 6 is a side elevational view of a magnetic clamping fixture.

DESCRIPTION OF THE PREFERRED EMBODIMENT

Referring to FIG. 1, the novel cigar tray of the present invention is illustrated in the general direction of arrow 10 which includes a cradle or tray 11 that is movably supported on a clamp 12 by means of an articulated arm 13. The tray includes side panels 14 and 15 that are joined along their common edges in order to provide a V-shaped cross-section. The tray 11 is intended to hold a tobacco product such as a cigar, as indicated in broken lines by numeral 16. As is illustrated, the tobacco product is supported in the tray even with a hot ash.

The clamp 12 includes levers 17 and 18 that are pivoted together at pivot 20 and are spring-biased with respect to each other by means of a helical or coil spring 21 so that the clamp portion of the levers 17 and 18, as represented by numerals 22 and 23, are pressed together in clamping relationship. Preferably, the clamp portions 22 and 23 include soft pads 24 and 25 which may readily engage with supporting structure such as the edge of a golf bag 26, as represented in broken lines. It is to be understood that other support structure may be employed, such as stanchions, rails, posts on a golf cart or the like.

The articulated arm 13 for adjustably moving the tray 11 with respect to the clamp 12 includes a plurality of individual elements, such as element 28, which includes a ball portion 30 and a skirt portion 31. The plurality of elements 28 are connected in end-to-end series relationship with the element at one end attached to the tray 11 while the element at its opposite end is attached to the clamp 12. Each of the respective elements may be articulated or adjusted into different positions so as to selectively locate the tray 11 accordingly.

Referring to FIG. 2, the spring 21 is more clearly illustrated for biasing the lever clamp portions 22 and 23 into a clamp position. The coil spring is wound about the pivot 20 and the opposite ends of the coil bear against the underside of the levers 17 and 18 respectively. As illustrated in FIG. 1, an end of the spring is tucked under a keeper 32.

Referring now in detail to FIG. 3, it can be seen that each of the respective elements 28 is arranged so that the ball 30 is snapped into a rotatable position with respect to the inside of the skirt 31 associated with an adjacent element 28. With respect to the last element in the series, the ball is connected to the panel 15 of the tray 11 by means of a threaded screw 33 threadably connected to a retaining nut 34 which is held by the element where the ball 30 integrally attaches with the skirt 31. Therefore, it can be seen that one element can be rotated on an adjacent element so that the plurality of elements provides a location adjustment or orientation adjustment for the tray 11. The tray 11 is shown in one position in solid lines and in an alternate position in broken lines.

Referring now in detail to FIG. 4, another or alternate embodiment is illustrated of the present invention wherein the arm 13 is rigid having ball connections with sockets 35 and 36 carried on the tray 11 and the clamp 12 respectively. Therefore, the tray 11 may be adjusted to various orientations with respect to the support clamp by means of the rigid arm 13 moving in the respective sockets.

In view of the foregoing, it can be seen that the tray of the present invention, when assembled with the arm and clamp, provides a means for permitting a lit tobacco product to rest in the tray. The tray is connected to a semi-rigid or flexible shaft that can be tilted or swiveled to permit adjustment so that the tray is level or slightly tilted. The opposite end of the shaft from its end connected to the tray is connected to a spring-loaded clamp to rigidly fasten the tray to a convenient support object such as a golf cart or golf bag. The tray remains fixed in position exactly as adjusted ready for use when the smoker decides to place a tobacco product in the tray.

FIG. 5 illustrates a tray 40 having a sheet of spring material folded over upon itself to provide a clamping action to releasably retain the tobacco product in the tray. A U-shaped cross section is made by lower sheet 41 and an upper sheet 42 with fold 43 joining the sheets together. Fitting 44 connects the tray 40 with the arm.

FIG. 6 is a magnetic mount 44 for releasably holding the arm and tray on a supporting structure.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A caddie for supporting a lighted tobacco product comprising:

an elongated tray of V-shaped cross-section having an open channel for insertable receiving the tobacco product;

a manually operated clamp having a pair of levers pivotally connected together;

resilient means disposed between said levers normally biasing said levers into a closed position; and articulated linkage having opposite ends connected to said tray and said clamp respectively.

2. The caddie as defined in claim 1 wherein:

said articulate linkage is a plurality of links arranged in an end-to-end relationship and movably coupled together to adjustable position with said tray to a selected orientation with respect to said clamp.

3. The caddie as defined in claim 1 wherein:

said articulated linkage is a rigid shaft terminating at its opposite ends with a ball;

a socket on said tray and on said clamp for movably holding said ball on said shaft at its opposite ends so as to allow positioning of said tray with respect to said clamp.

4. The caddie as defined in claim 2 wherein:

each of said links includes a ball integrally formed with a flared skirt having an internal cavity adapted to receive and retain a ball from an adjacent link in snap-lock releasable relationship.

5. The caddie as defined in claim 4 wherein:

a threaded screw and nut arrangement fixedly secures said articulated linkage to said tray and to said clamp respectively.

6. A caddie for supporting a lighted tobacco product comprising:

an elongated tray of U-shaped cross-section having an open channel for insertably receiving the tobacco product;

a magnetic clamp; and articulated linkage having opposite ends connected to said tray and said magnetic clamp respectively.

7. The caddie as defined in claim 6 wherein:

said tray is a releasably holding means for supporting the tobacco product.

* * * * *